US012372086B2

(12) United States Patent
Kachkovskiy

(10) Patent No.: US 12,372,086 B2
(45) Date of Patent: Jul. 29, 2025

(54) LINER BORE SEAL FOR FLUID END OF A HIGH PRESSURE RECIPROCATING PUMP

(71) Applicant: GD Energy Products, LLC, Tulsa, OK (US)

(72) Inventor: Vadim Kachkovskiy, Spring Mills, PA (US)

(73) Assignee: GD Energy Products, LLC, Tulsa, OK (US)

( * ) Notice: Subject to any disclaimer, the term of this patent is extended or adjusted under 35 U.S.C. 154(b) by 34 days.

(21) Appl. No.: 18/187,972

(22) Filed: Mar. 22, 2023

(65) Prior Publication Data

US 2024/0318647 A1 Sep. 26, 2024

(51) Int. Cl.

| | |
|---|---|
| ***F04B 53/16*** | (2006.01) |
| ***F04B 19/22*** | (2006.01) |
| ***F04B 53/14*** | (2006.01) |
| ***F04B 53/22*** | (2006.01) |

(52) U.S. Cl.

CPC ..... *F04B 53/166* (2013.01); *F04B 19/22* (2013.01); *F04B 53/143* (2013.01); *F04B 53/22* (2013.01)

(58) Field of Classification Search

CPC ..... F04B 53/166; F04B 19/22; F04B 53/14; F04B 53/22; F04B 1/0421; F04B 1/0538; F04B 53/02

See application file for complete search history.

(56) References Cited

U.S. PATENT DOCUMENTS

| | | | | |
|---|---|---|---|---|
| 3,652,098 A | | 3/1972 | Kawazu et al. | |
| 3,786,729 A | | 1/1974 | Rizzone | |
| 4,707,001 A | | 11/1987 | Johnson | |
| 5,540,570 A | * | 7/1996 | Schuller | F04B 1/0421 417/552 |
| 6,588,318 B2 | | 7/2003 | Aday et al. | |
| 11,125,331 B2 | | 9/2021 | Halmari et al. | |
| 2007/0092385 A1 | * | 4/2007 | Petrie Pe | F04B 53/22 417/395 |
| 2020/0200156 A1 | * | 6/2020 | Dall'Asta | F04B 53/04 |

(Continued)

FOREIGN PATENT DOCUMENTS

CN 114576156 A * 6/2022

OTHER PUBLICATIONS

CN114576156A translation (Year: 2024).*

(Continued)

*Primary Examiner* — David N Brandt

(74) *Attorney, Agent, or Firm* — Edell, Shapiro & Finnan, LLC

(57) ABSTRACT

A piston assembly for a reciprocating pump comprises a piston disposed within a liner, a flange extending radially outward from the liner, and a hollow cylindrical end part insertable into a bore in a fluid end of the reciprocating pump. A groove is formed about a circumference of an outer surface of the hollow cylindrical end part and is positioned to face a cylindrical, inner side wall of the bore in the fluid end when the end part is inserted into the bore. A seal element is seated in the groove and is configured to protrude radially outward therefrom. The seal element includes a sealing surface oriented generally parallel to a longitudinal axis of the hollow cylindrical liner to form a seal between the end part of the piston assembly and the cylindrical, inner side wall of the bore when the end part is inserted into the bore.

18 Claims, 9 Drawing Sheets

(56) References Cited

U.S. PATENT DOCUMENTS

| | | | | |
|---|---|---|---|---|
| 2020/0347843 | A1* | 11/2020 | Mullins | F04B 53/22 |
| 2021/0148208 | A1* | 5/2021 | Thomas | F16K 11/105 |
| 2021/0148349 | A1* | 5/2021 | Nowell | F04B 15/02 |

OTHER PUBLICATIONS

Gardner Denver, Single Acting Triplex Pump, Model PZL 11" Stroke, Parts List, 5th Edition, Aug. 2013.
GD Energy Products, Horizontal Directional Drilling Pump, Model GD-800 HDD, Parts List, Jun. 2022.

* cited by examiner

LINER BORE SEAL FOR FLUID END OF A HIGH PRESSURE RECIPROCATING PUMP

FIELD OF INVENTION

The present invention relates to the field of high-pressure reciprocating pumps and, in particular, to a liner bore seal arrangement for fluid ends of high-pressure reciprocating pumps.

BACKGROUND

High-pressure reciprocating pumps are often used to deliver high-pressure fluids during earth drilling operations. Pumps of this type typically include a fluid end having an internal pressure chamber in communication with a fluid inlet and a fluid outlet. Fluid is drawn into the pressure chamber via the fluid inlet and expelled from the pressure chamber via the fluid outlet by reciprocating movement of one or more pistons. Each piston is disposed within a hollow, cylindrical liner attached to the fluid end of the pump and is moved in a reciprocating manner by a power end of the pump. In conventional high-pressure reciprocating pumps, the liner is attached to the fluid end of the pump with a face seal whose sealing surface is oriented perpendicular to a longitudinal axis of the liner. Typically, a large flange is required to successfully mount a liner using a face seal, limiting the size and number of piston assemblies that may be arranged on a reciprocating pump.

SUMMARY

The present application relates to techniques for mounting a piston assembly on a fluid end of a high-pressure reciprocating pump. The techniques may be embodied as a piston assembly that is provided independent of any other elements or a piston assembly that is incorporated in a fluid end and/or in a reciprocating pump. Additionally, the techniques may be embodied as a method for mounting a piston assembly on a fluid end of a high-pressure reciprocating pump.

More specifically, in accordance with at least one embodiment, the present application is directed to a piston assembly for a reciprocating pump with a power end and a fluid end. The piston assembly comprises a liner and a piston disposed within the liner. The piston is coupled with the power end of the reciprocating pump to move in a reciprocating manner within the liner. The liner comprises a hollow cylindrical body with inner and outer surfaces of circular cross-section. The piston assembly further comprises a hollow cylindrical end part that is configured to be insertable into a bore of circular cross-section formed in the fluid end of the reciprocating pump. A groove is formed about a circumference of the outer surface of the hollow cylindrical end part and is positioned to face a cylindrical, inner side wall of the bore in the fluid end of the reciprocating pump when the end part is inserted into the bore. A seal element is seated in the groove and is configured to protrude radially outward therefrom. The seal element includes a sealing surface oriented generally parallel to a longitudinal axis of the hollow cylindrical end part to form a seal between the end part and the inner side wall of the bore when the end part is inserted into the bore.

In at least some embodiments, the piston assembly further comprises a flange protruding radially outward from the hollow cylindrical liner, the flange being configured to abut the fluid end adjacent the bore. The flange can be: (a) removably or irremovably coupled to the hollow cylindrical liner; and/or (b) configured to abut or be spaced apart from the fluid end casing of the reciprocating pump.

In at least some embodiments, a width of the flange is less than a height of the flange.

In at least some embodiments, a width of the flange is about the same as a diameter of the outer surface of the hollow cylindrical liner.

In at least some embodiments, the hollow cylindrical liner includes a pair of flat surfaces formed on diametrically opposite sides of the hollow cylindrical liner, and the width of the flange is the same as the distance between the pair of flat surfaces on the hollow cylindrical liner.

In at least some embodiments, the flange includes a pair of flat edges in same respective planes as the pair of flat surfaces on the hollow cylindrical liner.

In at least some embodiments, the pair of flat edges and the pair of flat surfaces are parallel to one another.

In at least some embodiments, the flange of the piston assembly comprises a truncated disk.

In at least some embodiments, the truncated disk comprises at least one flat edge.

In at least some embodiments, the truncated disk comprises two flat edges diametrically opposed to one another.

In at least some embodiments, a plurality of holes are formed through the flange in alignment with threaded openings in the fluid end, and further comprising a plurality of bolts configured to extend through the plurality of holes and into the threaded openings in the fluid end.

In at least some embodiments, the plurality of holes are arranged in two arcs that are circumferentially spaced from one another.

In at least some embodiments, an inner surface of the hollow cylindrical liner has a first diameter, and an inner surface of the hollow cylindrical end part has a second diameter that is smaller than the first diameter.

In at least some embodiments, an angled shoulder connecting the first and second inner surfaces is provided.

In at least some embodiments, the bore in the fluid end includes a counterbored portion, and an end face of the hollow cylindrical end part is configured to abut a shoulder defined by counterbored portion of the bore.

In at least some embodiments, the seal element comprises a ring-shaped member made of a compressible material.

In at least some embodiments, the ring-shaped member has a round (e.g., circular or ovular) cross-section, such as an O-shaped cross-section. However, other embodiments might have a P-shaped cross-section, a D-shaped cross-section, or any other cross-sectional shape, including non-uniform cross-sectional shapes. In fact, at higher pressures, non-ovular shapes, such as D-shaped cross sections, may provide optimal sealing.

In at least some embodiments, the seal element is a rubber seal having an uncompressed width of 3/16 inches to 7/16 inches and an uncompressed height of 3/16 inches to 7/16 inches. For example, the seal element may be have a circular cross section with a diameter in the range of 3/16 inches to 7/16 inches.

In at least some embodiments, the piston assembly further comprises one or more back-up rings disposed in the groove. For example, a pair of backup rings may be disposed in the groove on opposite sides of the seal element.

In at least some embodiments, the present application is directed to a reciprocating pump comprising a power end, a fluid end, and at least one piston assembly having a first end coupled with the fluid end of the pump, and a second end coupled with the power end of the pump. The fluid end of the pump comprises a casing with a pressure chamber, a fluid inlet opening, and a fluid outlet opening formed therein, and further comprises a bore of circular cross-section formed through a wall of the casing in fluid communication with the pressure chamber. The piston assembly includes a hollow cylindrical liner and a piston disposed within the hollow cylindrical liner and coupled with the power end of the pump. A hollow cylindrical end part of the piston assembly is inserted into the bore formed through the wall of the casing, and a seal element is disposed between an outer surface of the hollow cylindrical end part and an inner side wall of the bore. The seal element protrudes radially outward from a circumferential groove formed in an outer surface of the hollow cylindrical end part and includes a sealing surface oriented generally parallel to a longitudinal axis of the hollow cylindrical liner to form a seal between the hollow cylindrical end part of the piston assembly and an inner side wall of the bore.

In at least some embodiments of a reciprocating pump, the piston assembly is one of a plurality of piston assemblies, and wherein each piston assembly comprises a flange configured to abut the fluid end casing and including a truncated disk with a flat edge.

Still further, in some embodiments of a reciprocating pump, at least one of the plurality of piston assemblies arranged side-by-side comprises a flange including a truncated disk with two flat edges.

In some instances, the at least one piston assembly comprising a flange including a truncated disk with two flat edges is disposed between two of the other piston assemblies.

In some embodiments, the present application is directed to a method of attaching a first piston assembly to a fluid end of a reciprocating pump. The method comprises positioning a seal element in a groove formed about the circumference of a hollow cylindrical end part of the first piston assembly to define a sealing surface parallel to a longitudinal axis of the end part. The method further comprises forming a bore seal by inserting the hollow cylindrical end part of the first piston assembly into a bore formed through a wall of a casing of the fluid end. The method further comprises attaching the first piston assembly to the fluid end with threaded fasteners extending through a first flange extending radially outward from a hollow cylindrical liner of the first piston assembly.

In at least some embodiments, a width of the first flange in a first direction is less than a height of the first flange in a second direction orthogonal to the first direction, and the method further comprises positioning a second piston assembly side-by-side with the first piston assembly in the width direction.

In at least some embodiments, the second piston assembly includes a second flange extending radially outward from a second hollow cylindrical liner, and wherein a width of the second flange is less than a height of the second flange.

In at least some embodiments, the first and second flanges include respective flat edges that are positioned in close proximity and/or that abut one another in the width direction.

In at least some embodiments, respective widths of the first and second flanges are about the same as respective outer diameters of the first and second hollow cylindrical liners.

In at least some embodiments, the method further comprises positioning second and third piston assemblies on opposite sides of the first piston assembly in the width direction. For example, the flat edges on respective flanges of the second and third piston assemblies may be positioned in close proximity to and/or may abut flat edges on opposite sides of the flange of the first piston assembly.

Other features and advantages of the invention will be apparent from the specification and drawings.

BRIEF DESCRIPTION OF THE DRAWINGS

To complete the description and in order to provide for a better understanding of the present invention, a set of drawings is provided. In the drawings, like reference numerals in the various figures are utilized to designate like components. The drawings form an integral part of the description and illustrate embodiments of the present invention, which should not be interpreted as restricting the scope of the invention, but just as examples of how the invention can be carried out. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the piston assembly presented herein provides an improved seal with the fluid end of a reciprocating pump, at least as compared to conventional face seals. The seal is improved because it may hold a higher pressure than conventional face seals and/or because the seal may have an extended lifespan that conventional face seals (e.g., since the seal presented herein may not wear as fast as a face seal). That is, the seal may be improved because it may stronger and/or because it may last longer (reducing downtime required for seal changes) as compared to known liner seals. Moreover, the piston assembly presented herein may allow for a larger piston which can increase maximum flow rate of the reciprocating pump and/or provide geometric improvements in a fluid end (e.g., by enabling a larger range of bore spacing options, seal diameter options, etc.).

Still further, the piston assembly presented herein may last longer and be easier and less costly to fix when it fails. This is at least partly because the seal presented herein may allow a piston assembly to be coupled to a fluid end casing with a reduced amount of force, at least as compared to the force required to secure a face seal against a fluid end casing. This may reduce a load on the piston assembly and extend the lifespan of the piston assembly. This force reduction may be achieved because the seal is designed and/or arranged to seal against the fluid end casing independent of the coupling/clamping force. That is, the seal presented herein is not directly activated or compressed by a coupling/clamping force created during installation of the piston assembly in/on a fluid end casing.

Figure 1:
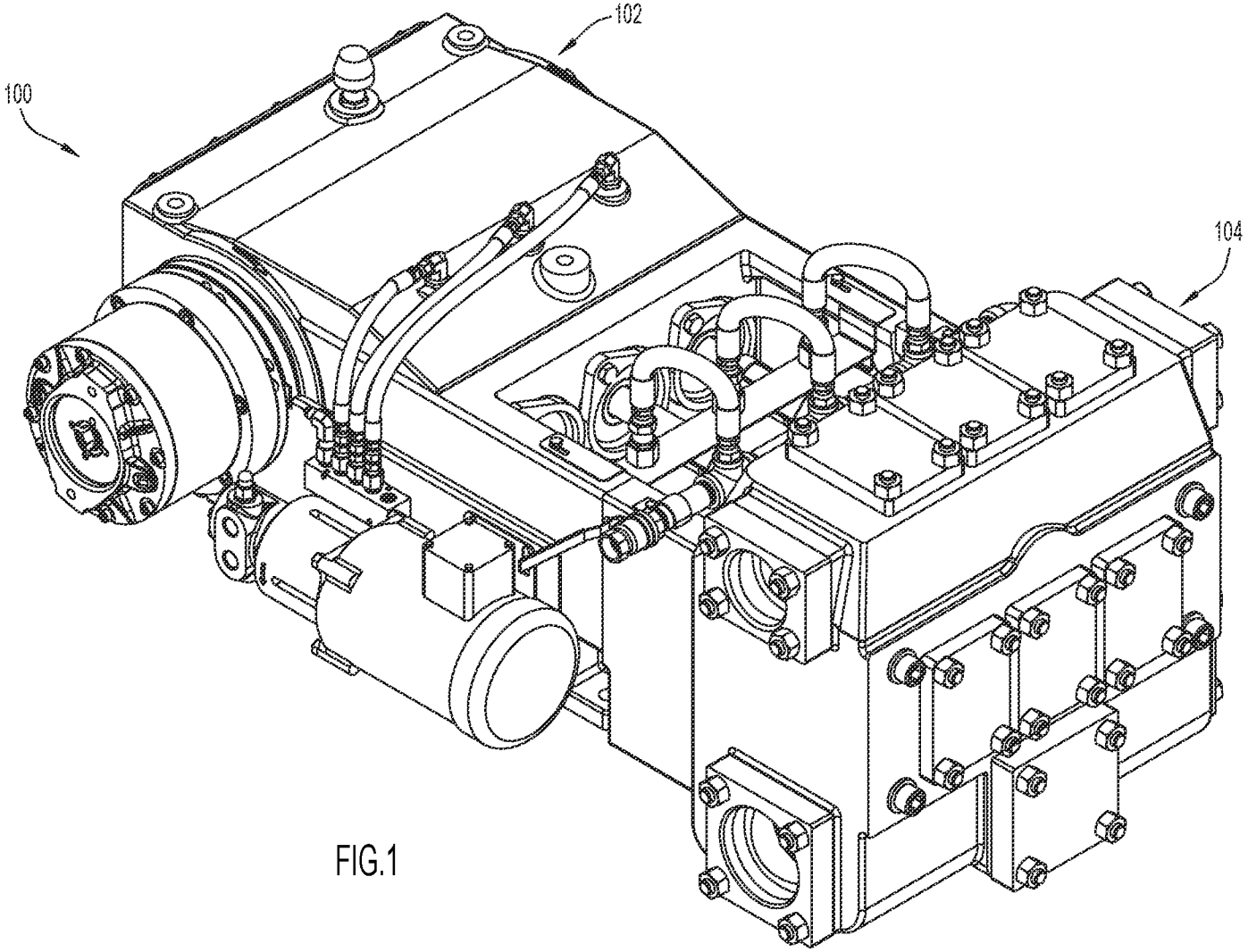
FIG. 1 is a perspective view of a reciprocating pump according to an example embodiment.

FIG. 1 shows an example embodiment of a reciprocating pump 100 in which the piston assembly presented herein may be included. The reciprocating pump 100 includes a power end 102 and a fluid end 104. The power end 102 of the pump 100 includes a crankshaft that drives a plurality of reciprocating pistons in communication with chambers in the fluid end 104 to pump fluid at high-pressure. Generally, the power end 102 of the pump is capable of generating forces sufficient to cause the fluid end 104 to pump fluids at pressures suitable for earth drilling operations, such as horizontal directional drilling (HDD) operations. However, to be clear, the techniques presented herein are not and should not be limited to HDD operations.

That said, HDD is a trenchless method for installing pipes and cables underground. The method involves boring a non-vertical tunnel beneath the surface using a drilling fluid (typically a combination of water and bentonite clay) to help remove cuttings, stabilize the tunnel, cool the cutting tools, and lubricate the pipe string. The drilling fluid may also be used to rotate the drill bit to remove material. As the drill bit is rotating, the pressure and fluid produced by the HDD pump may help stabilize the tunnel. The mud extracted from this process may also be filtered and reused as drilling fluid.

While HDD pumps with conventional piston assemblies are capable of maximum fluid pressures up to about 3,000 psi and flow rates up to about 460 gpm, higher maximum fluid pressures and flow rates are desirable to improve the efficiency of HDD operations. At the same time, the size and weight of the pump should preferably not be materially increased in comparison with conventional HDD pumps, so that the pump may be transported and setup in the normal manner (i.e., without the need to replace existing trucks, cranes, and other equipment currently used to transport and setup conventional HDD pumps). Similar preferences also apply to other reciprocating pumps that are usable for drilling.

A reciprocating pump utilizing the piston assembly presented herein may increase maximum fluid pressure and flow rate, without materially increasing the size and weight of the pump, such that the pump may be transported and setup in the normal manner. In an example, the reciprocating pump and piston assembly presented herein may increase maximum fluid pressure by as much as 50%-150% (e.g., to a maximum fluid pressure of 4,500 psi to 7,500 psi) and flow rate by as much as 15%-35%, or more (e.g., to an output flow of up to 1,000 gpm) without materially increasing the size or weight of the pump, such that the pump may be transported and setup using the same equipment currently used for conventional pumps (e.g., the equipment currently used for conventional HDD pumps). Additionally, since a reciprocating pump utilizing the piston assembly presented herein may allow for a larger diameter piston, the piston assembly presented herein may allow for geometric improvements in a fluid end (e.g., by enabling a larger range of bore spacing options, seal diameter options, etc.).

Figure 2:
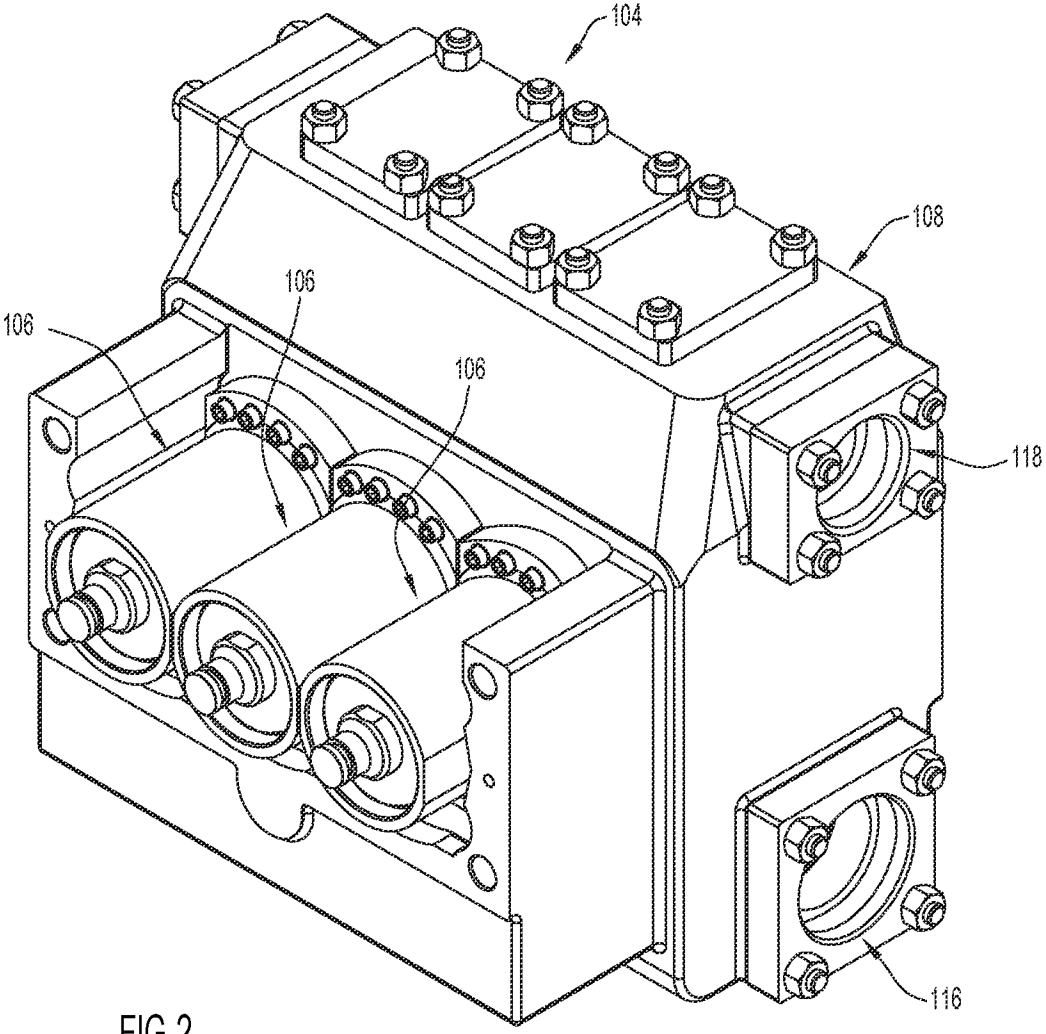
FIG. 2 is a perspective view of the fluid end and piston assemblies of the reciprocating pump shown in FIG. 1.
Figure 3:
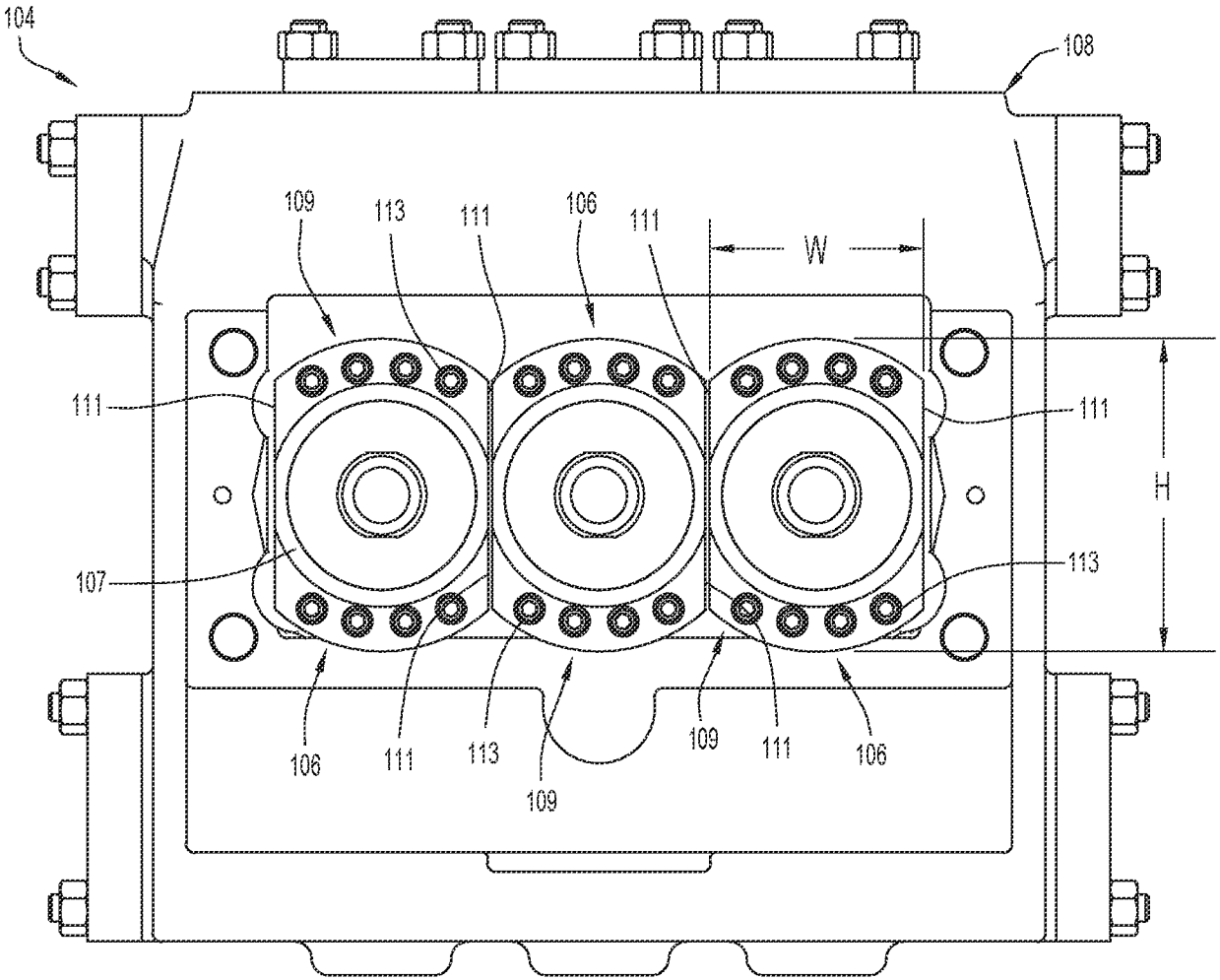
FIG. 3 is a rear view of the fluid end and piston assemblies shown in FIG. 2.

Referring now to FIGS. 2 and 3, the fluid end 104 and piston assemblies 106 of the reciprocating pump 100 are shown in greater detail. While the reciprocating pump 100 is shown with three piston assemblies 106, it will be appreciated that the principles presented herein may be applied to any reciprocating pump having two or more piston assemblies. Each piston assembly 106 includes a hollow cylindrical liner 107 and a flange 109 protruding outwardly from the hollow cylindrical liner in a radial, transverse, or lateral direction that is perpendicular to a longitudinal or lengthwise axis (depicted in FIG. 4 at 114) of the hollow cylindrical liner. The flange 109 is configured to abut a casing 108 of the fluid end 104 when piston assembly 106 is inserted into a bore in the fluid end casing 108. However, the flange 109 need not abut casing 108 and could be coupled thereto while remaining spaced therefrom.

In some instances, such as the embodiment depicted in FIGS. 2-8, the flange 109 is formed integrally with the hollow cylindrical liner 107. But, in other instances, such as the embodiment depicted in FIG. 9A, the flange 109 may be formed separately from the hollow cylindrical liner 107 and be installed therearound (with or without being secured directly to the hollow cylindrical liner 107). For example, some smaller piston assembly 106 (e.g., for smaller and/or lighter horsepower pumps, such as 250 horsepower (hp) to 800 hp pumps) may include single-piece piston assemblies 106 where the flange 109 is formed integrally with the liner 107. By comparison, some larger piston assemblies 106 (e.g., for larger and/or lighter horsepower pumps, such as 1600 hp to 2400 hp or more pumps) may include multi-piece (e.g., two-piece) piston assemblies 106 where the flange 109 is formed separately from the liner 107. Both constructions may realize the advantages described herein.

Regardless of how the flange 109 is formed (i.e., integrally with or separately from liner 107), the flange 109 may extend circumferentially around an entire circumference of the outer surface of the hollow cylindrical liner 107 or around only portions of the circumference of the outer surface of the hollow cylindrical liner 107. In either case, a width of the flange 109 is preferably the same as, or only slightly larger than, an outer diameter of the hollow cylindrical liner 107 so that multiple piston assemblies may be arranged side-by-side in the widthwise direction with little or no gap between the piston assemblies.

In an example embodiment, a height H of the flange 109 may be greater than the width W of the flange 109. The height of the flange 109 may also vary around a circumference of the piston liner. For example, the flange 109 may comprise a truncated disk with at least one flat edge 111. That is, the flange 109 may comprise a circular disk with at least one segment missing, where the at least one flat edge 111 is defined by a chord joining two points along the circumference of the disk. In a preferred embodiment, the flange 109 may comprise a truncated disk with two flat edges 111 diametrically opposed to one another (i.e., a circular disk with two segments missing on diametrically opposite sides of the disk). In the case of a flange 109 in the form of a truncated disk with two flat edges 111, the width W of the flange 109 is the distance between the two flat edges, and the height H of the flange 109 is the outer diameter of the disk. Thus, the height of such a flange is greater than its width, allowing multiple piston assemblies to be arranged side-by-side in the widthwise direction with little or no gap between the piston assemblies, while at the same time providing sufficient room in the height direction for threaded fasteners to secure the flange to the fluid end.

A plurality of holes may be formed through the flange 109 in alignment with threaded openings in the fluid end casing 108, and a plurality of threaded fasteners 113 (such as bolts) may be configured to extend through the plurality of holes and into the threaded openings in the fluid end casing to secure the piston assembly 106 to the fluid end 104. The plurality of holes in the flange 109 may be formed concentric with, and equidistant from, the central longitudinal axis of the hollow cylindrical liner 107 or may be formed at different distances from the central longitudinal axis of the hollow cylindrical liner. In an example embodiment, two groups of four fasteners 113 are arranged along arcs on diametrically opposite sides of the hollow cylindrical liner 107. Each arc preferably subtends an angle of less than 180°, and more preferably less than 90°, such that ends of the arcs are circumferentially spaced from one another. While eight fasteners 113 (two groups of four fasteners on diametrically opposite sides of the liner 107) has been found to be sufficient to secure a piston assembly 106 according to the present application, it will be appreciated that fewer than or greater than eight fasteners may be used. Referring still to FIGS. 2 and 3, the piston assemblies 106 are arranged side-by-side in a widthwise direction, with at least one flat edge 111 of each piston assembly's flange 109 being in close proximity to a flat edge 111 of a neighboring piston assemblies flange 109. In the case of three piston assemblies 106, as shown, both flat edges 111 of the central piston assembly's flange 109 are in close proximity to respective flat edges 111 of neighboring piston assemblies 106. In fact, if desired, the flat edges 111 of neighboring piston assemblies could abut. In an example embodiment, a width W of each piston assembly's flange 109 is equal to an outer diameter of the hollow cylindrical liner 107, so that there is little or no gap between the piston assemblies 106 in a widthwise direction. As a result, the size of the hollow cylindrical liner 107 for each piston assembly 106 may be maximized, thereby increasing maximum pressure and flow rate of the reciprocating pump 100. This may also allow for geometric improvements in a fluid end (e.g., by enabling a larger range of bore spacing options, seal diameter options, etc.).

Figure 4:
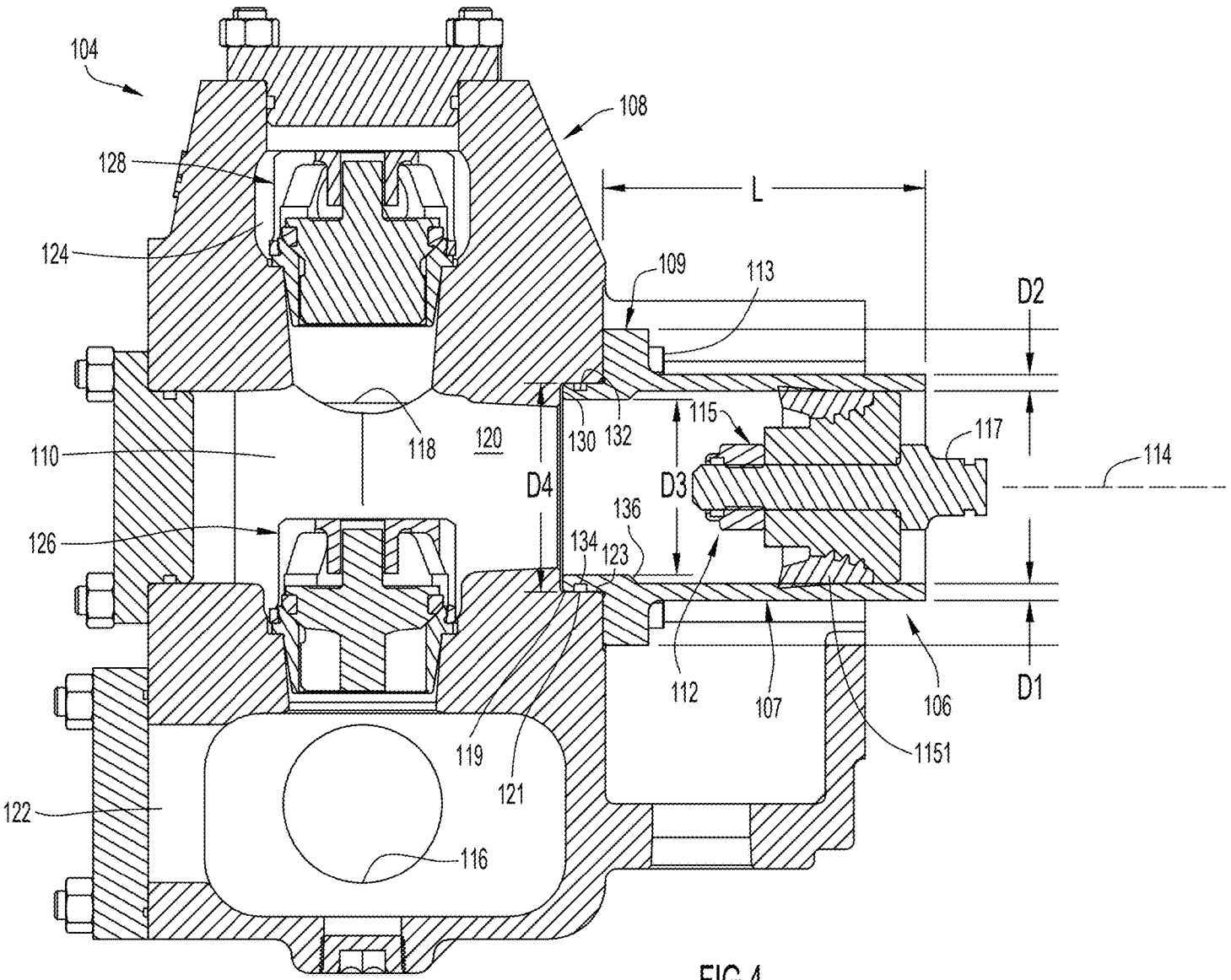
FIG. 4 is cross sectional view taken along line 4-4 of FIG. 3.

Referring now to FIG. 4, a cross-sectional view is shown of a piston assembly 106 installed on the fluid end 104 of a reciprocating pump. Piston assembly 106 includes a piston 112 disposed within a hollow cylindrical liner 107 having a longitudinal axis 114. The piston 112 includes a piston head 115 mounted on a piston rod 117. The piston rod 117 is configured to be coupled with the power end of the pump to cause the piston head 115 to be moved in a reciprocating manner within the hollow cylindrical liner 107 such that a piston seal 1151 included on the piston head 115 reciprocally slides along an inner surface of the hollow cylindrical liner 107. The flange 109 extends radially outward from an end of the hollow cylindrical liner 107 adjacent the fluid end 104, and a hollow cylindrical protrusion extends axially from the flange 109 to define a hollow cylindrical end part 119 of the piston assembly 106.

The hollow cylindrical end part 119 is arranged concentric with the longitudinal axis 114 of the liner 107. The end part 119 of the piston assembly 106 is configured to be received within a bore 120 formed through a wall of the fluid end casing 108. More specifically, an outer diameter of the end part 119 is slightly smaller than an inner diameter of the bore 120 so that there is a small radial gap between the components. An inner diameter D3 of the end part 119 may be smaller than an inner diameter of the liner 107 and connected thereto by an angled shoulder 136 of frustoconical configuration. The piston assembly 106 may be held in place by threaded fasteners 113 extending through holes in the flange 109 of the piston assembly 106 into threaded holes in the fluid end casing 108. A bore seal 121 may be formed in the radial gap between an outer cylindrical surface of the end part 119 of the piston assembly 106 and an inner cylindrical surface of the bore 120 in the fluid end casing 108 to prevent high-pressure fluid from leaking out of the pump.

Notably, because the seal 121 is a radial/bore seal, the fasteners 113 can connect flange 109 to fluid end casing 108 with a reduced amount of force, at least as compared to the force required to secure a face seal against the fluid end casing 108. That is, with bore seal 121, the clamp load applied to the piston assembly 106 can be reduced as compared to the clamp load require to secure a piston assembly with a face seal to the casing 108. This is because the clamp load applied to a piston assembly with a face seal controls the sealing provided by the face seal (i.e., the clamp load "activates" the seal and, as such, the seal is dependent on the clamp load). By comparison, sealing provided by bore seal 121 is created independent of the clamp load. This reduction in clamping/securing force reduces a load on the piston assembly 106 and extends the lifespan of the piston assembly 106.

The fluid end casing 108 forms a pumping chamber 110 that is in fluid communication with the piston assembly 106 via the bore 120 in the wall of the fluid end casing 108. Fluid end 104 also includes a fluid inlet opening 116 and a fluid outlet opening 118 formed in the wall of the fluid end casing 108. Additionally, fluid end casing 108 forms a fluid intake passage 122 extending from the fluid inlet opening 116 to the pumping chamber 110, and a fluid outlet passage 124 extending from the pumping chamber 110 to the fluid outlet opening 118.

A first one-way valve 126 is disposed within the fluid intake passage 122 and is configured to move from a closed state (preventing fluid flow from the fluid inlet opening 116 into the pumping chamber 110) to an open state (allowing fluid flow from the fluid inlet opening 116 into the pumping chamber 110) when the piston assembly 106 creates sufficient suction (e.g., when the piston 112 inside the liner 107 is moved from a top end of its stroke—near a first end of the liner—towards a bottom end of its stroke—near a second end of the liner—by the power end of the pump). A second one-way valve 128 is disposed within the fluid outlet passage 124 and is configured to move from a closed state (preventing fluid flow from the pumping chamber 110 to the fluid outlet opening 118) to an open state (allowing fluid flow from the pumping chamber 110 to the fluid outlet opening 118) when the piston assembly 106 pressurizes fluid contained in the pumping chamber 110 to a sufficiently high pressure (e.g., when the piston 112 inside the liner is moved from a bottom end of its stroke towards a top end of its stroke by the power end of the pump).

It will also be understood that essentially identical pumping chambers may be formed by the fluid end casing 108 in fluid communication with the other piston assemblies. For example, fluid end 104 can include multiple pumping chambers 110 arranged side-by-side. In some embodiments, the fluid end 104 may be modular and different casing segments may house one or more pumping chambers. Additionally or alternatively, multiple pumping chambers may be formed in a single casing segment or casing. Regardless of how the casing 108 is formed, the one or more pumping chambers 110 included therein are preferably arranged side-by-side so as to generate substantially parallel pumping action.

Referring still to FIG. 4, a portion of the bore 120 receiving the piston assembly 106 may be counterbored at 123 to create a flat shoulder 130 that may serve as a stop for a front edge or face of the end part 119 of the piston assembly 106 when inserting the piston assembly into the bore during installation. A diameter D4 of the counterbored portion 123 of the bore 120 may be slightly larger than an outer diameter of the end part 119 of the piston assembly 106 to define a small radial gap (e.g., 0.07 mm) therebetween. A depth of the counterbored portion 123 of the bore is such that, when a terminal end of the end part 119 of the piston assembly 106 abuts the shoulder 130 at the bottom of the counterbore 123, the flange 109 extending radially outwardly from the liner 107 abuts an outer surface of the fluid end casing 108.

Referring still to FIG. 4, details of the bore seal 121 between the hollow cylindrical end part 119 of the piston assembly 106 and the counterbore 123 in the fluid end casing 108 can be seen. The bore seal 121 comprises a groove 132 that extends circumferentially around an outer cylindrical surface of the end part 119 of the piston assembly 106, and a seal element 134 that is disposed within the groove 132. The groove 132 is located on a portion of the end part 119 that is received within the counterbored portion 123 of bore 120, and the groove 132 faces a cylindrical, inner side wall of the counterbored portion 123 of bore 120. In a preferred embodiment, the groove 132 has a rectangular cross-section. In an example embodiment, the rectangular groove is 0.28 inches wide (in an axial direction parallel to a longitudinal axis of the liner) and 0.17 inches deep (in a radial direction relative to the longitudinal axis of the liner). However, the groove 132 may have any cross-sectional shape suitable for retaining the sealing element. For example, groove 132 may be larger for larger pumps.

The seal element 134 is disposed in the groove 132 and extends radially outward, across the gap, to define a sealing surface oriented parallel to the longitudinal axis of the piston liner 107. The seal element 134 is preferably made of a compressible material, such as rubber. Thus, when the sealing surface of the seal element 134 engages an inner surface of the counterbore 123 it forms a seal between the piston assembly 106 and the fluid end 104. As such, no seal element is needed between the shoulder of the counterbore and a front edge or face of the piston assembly. It has been found that a bore seal 121 according to the present application allows the piston assembly 106 to be securely fastened with a smaller flange 109, providing additional room for a larger liner 107 that can generate a higher maximum flow rate. Additionally, a wall thickness (D2−D1) of the liner 107 may be decreased, thereby increasing a volume of fluid that may be pumped by the piston assembly 106 during each stroke.

Figure 5B:
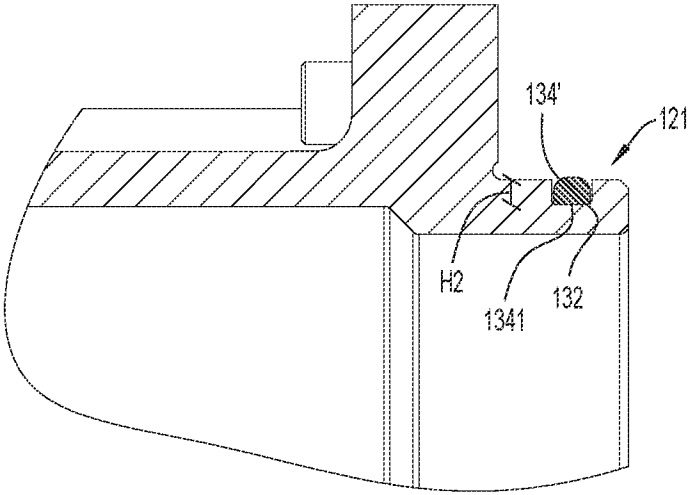
FIGS. 5*a*-5*d* are detail views of a portion of the cross sectional view of FIG. 4 that illustrate different example bore seal arrangements installed in a groove of a piston assembly liner.
Figure 5D:
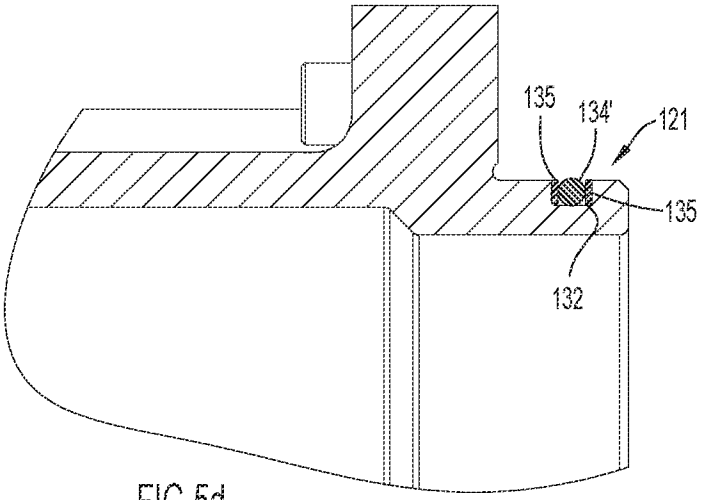
Figure 5A:
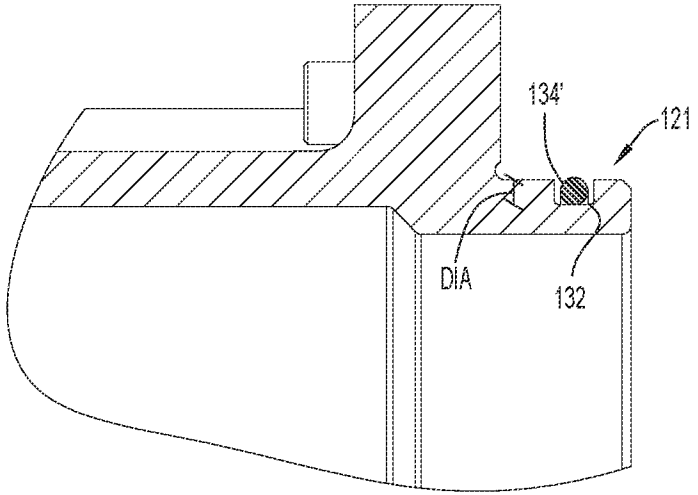
Figure 5C:
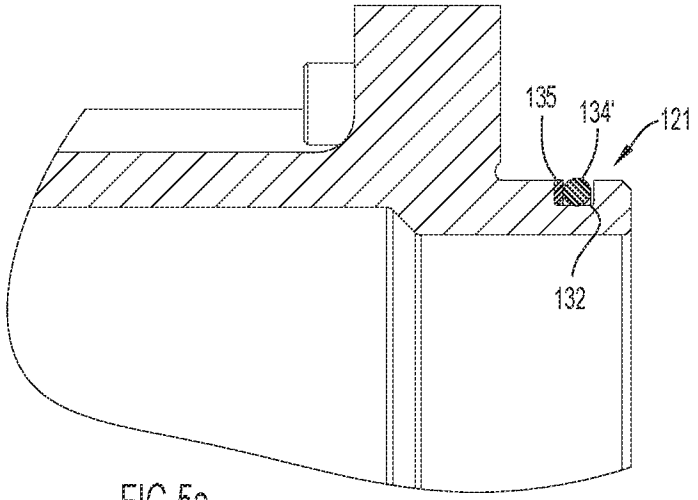

Now turning to FIGS. 5*a*-5*d*, in different embodiments, the bore seal 121 can include a seal element 134 of different shapes and sizes, and/or the bore seal 121 include different components, examples of which are illustrated in FIGS. 5*a*-5*c*. First, in FIG. 5*a*, the seal element 134' comprises a ring-shaped member with a round (e.g., circular or ovular) cross-section, such as an O-shaped cross-section, having an uncompressed diameter DIA of 3/16 inches to 7/16 inches. However, other embodiments might have a P-shaped cross-section, a D-shaped cross-section, or any other cross-sectional shape, including non-uniform cross-sectional shapes. In fact, at higher pressures, non-ovular shapes, such as D-shaped cross sections, may provide optimal sealing. Any of these shapes may have uncompressed width of 3/16 inches to 7/16 inches and an uncompressed height of 3/16 inches to 7/16 inches, or may have different dimensions. As an example, FIG. 5*b* illustrates a D-shaped seal element 134". As can be seen, the D-shaped seal element 134" includes a flat bottom 1341 that can be beneficial for higher pressures and the D-shaped seal element 134" has an uncompressed height H2 of 3/16 inches to 7/16 inches.

Regardless of the shape and the size of the seal element 134, the bore seal 121 may, in some embodiments, include one or more backup rings 135. For example, in the embodiment depicted in FIG. 5*c*, the bore seal 121 comprises round seal element 134' and backup ring 135. The backup ring 135 is disposed upstream of the seal element 134' (i.e., the one or more backup rings comprise a ring 135 between the round seal element 134' and flange 109) and is configured to support the seal element 134 against forces acting in an upstream direction (i.e., from the pumping chamber towards the flange 109). However, this is merely on example, and other examples may include any arrangement of backup rings, of any shape or configuration. As one such additional example, FIG. 5*d* shows a pair of backup rings 135 disposed in the groove 132 on opposite axial hollow sides of seal element 134'.

In an example embodiment, the backup rings are flat disks having an outer diameter greater than an outer diameter of the end part 119 of the piston assembly 106 and less than an outer diameter of the seal element 134 in a compressed state to provide support for the seal element in a direction parallel to the longitudinal axis 114 of the liner 107. The one or more backup rings (also called backup disks or disks) are preferably made of a material of sufficient rigidity and strength to support the seal element 134 in the parallel direction. The disks can be sized as needed, but as an example, the disks may be made of a metal material (such as steel) and have an outer diameter of about 4 inches to 5 inches (e.g., 4.6 inches) and a thickness of about 1/8 inches.

Figure 6:
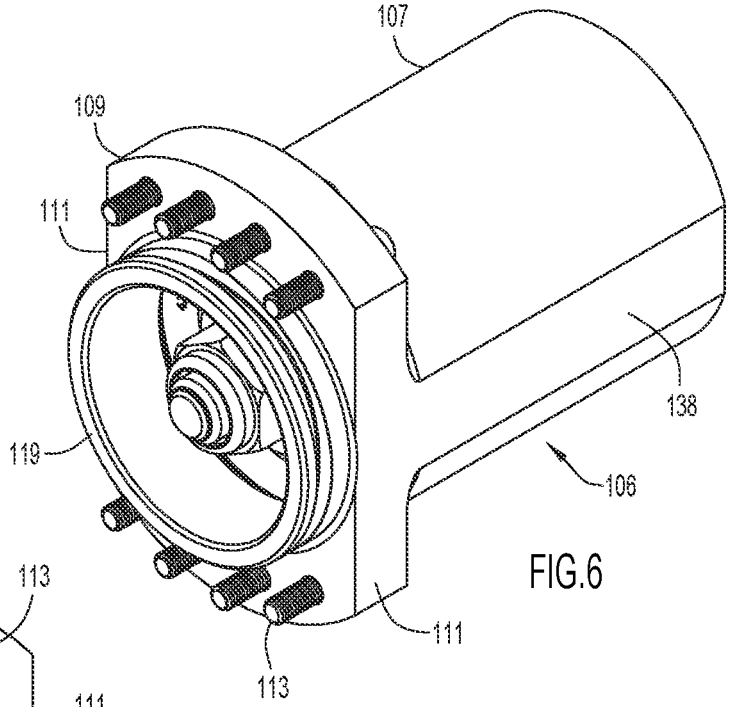
FIG. 6 is a perspective view of a piston assembly of the reciprocating pump shown in FIG. 2.
Figure 7:
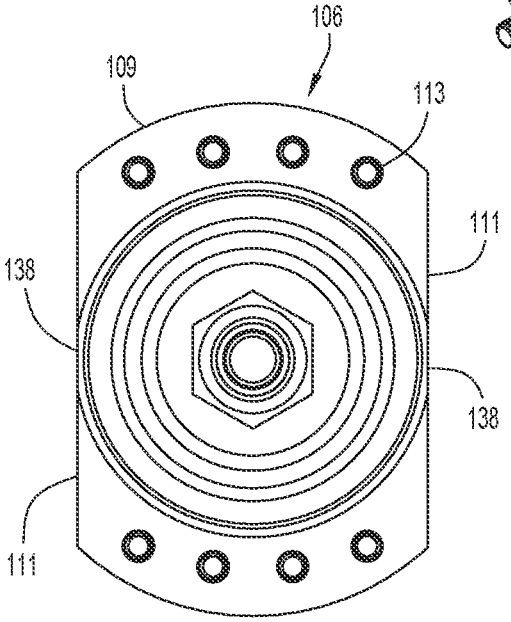
FIG. 7 is a front view of the piston assembly shown in FIG. 6.
Figure 8:
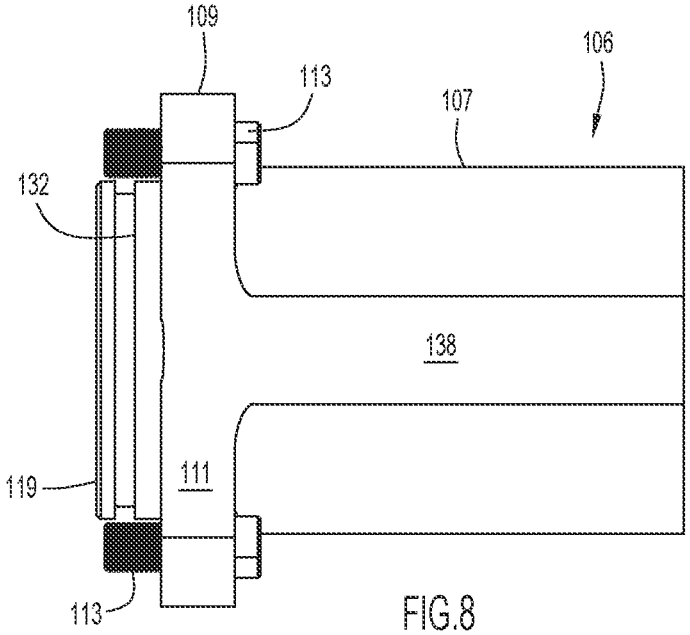
FIG. 8 is a side view of the piston assembly shown in FIG. 6.

FIGS. 6-8 show an example piston assembly 106 according to the present application. In this example, the liner 107 is a hollow cylinder with two flat surfaces 138 formed on diametrically opposite sides of the liner 107. The two flat surfaces 138 extend axially (i.e., longitudinally) along a length of the liner 107 in parallel relation to one another. The flange 109 in this example comprises a truncated disk with two flat edges 111 diametrically opposed to one another (i.e., a circular disk with two segments missing on diametrically opposite sides of the disk).

The flat edges 111 of the flange 109 intersect the flat surfaces 138 on opposite sides of the liner 107 to define a generally T-shaped planar surface on each side of the piston assembly 106. The T-shaped planar surfaces on opposite sides of the piston assembly 106 are configured to be positioned in close proximity to and/or abut similar planar surface on the sides of neighboring piston assemblies when the piston assemblies are arranged side-by-side in a widthwise direction (e.g., as shown in FIG. 3). It will be appreciated that a width of the flange 109 (i.e., the distance W between the flat edges 111) in this example matches a width of the liner 107 (i.e., the distance D between the flat planar surfaces 138). The height H of the flange is greater than the width W of the flange to accommodate groups of fasteners 113 on diametrically opposite sides of the liner 107. For example, the height H of the flange may be such that there is room for eight through holes, formed in groups of four on diametrically opposite sides of the liner 107, to receive an equal number of threaded fasteners 113. It has been found that, with a bore seal according to the present application, it is possible to securely fasten the piston assembly 106 to the fluid end with fewer fasteners, even if the fasteners are not uniformly distributed around the entire circumference of the liner 107.

Referring still to FIGS. 6-8, it can be seen that the end part 119 of the piston assembly has a hollow cylindrical configuration with an outer diameter that is less than an outer diameter of the liner 107 but greater than an inner diameter of the shoulder defined by the counterbore. A groove 132 of rectangular cross-section is formed about a circumference of the hollow cylindrical end part 119 to receive a sealing element, such as the sealing element described above.

During operation of pump 100, each stroke of the piston 112 may cause low pressure fluid to be drawn into the fluid end 104 via one or more openings, as represented by the fluid inlet opening 116, and high-pressure fluid to be discharged from the fluid end 104 via one or more openings, as represented by the fluid outlet opening 118. In at least some embodiments, fluid enters fluid inlet opening 116 via pipes of a first piping system, flows through pumping chamber 110 (due to reciprocation of piston 112), and then flows through fluid outlet opening 118 into pipes of a second piping system. In various embodiments, fluid end 104 may receive and discharge fluid via any number of pipes and/or conduits, along pathways of any desirable size or shape.

More specifically, during operation of pump 100, when the piston 112 inside the liner 107 is moved from a top end of its stroke towards a bottom end of its stroke, a negative pressure (i.e., a suction force) is created in the pumping chamber 110 that causes the first one-way valve 126 disposed within the fluid intake passage to move from a closed state (preventing fluid flow from the fluid inlet opening 116 into the pumping chamber 110) to an open state (allowing fluid flow from the fluid inlet opening 116 into the pumping chamber 110). At the same time, the negative pressure in the pumping chamber 110 maintains the second one-way valve 128 in the fluid outlet passage 124 in a closed state (preventing fluid flow from the pumping chamber 110 to the fluid outlet opening 118 and vice versa). When the piston 112 inside the liner 107 is moved from a bottom end of its stroke towards a top end of its stroke, pressurized fluid in the pumping chamber 110 causes the first one-way valve 126 in the fluid intake passage 122 to move to its closed state and causes the second one-way valve 128 in the fluid outlet passage 124 to move from its closed state to an open state (allowing high-pressure fluid to flow from the pumping chamber 110 to the fluid outlet opening 118). It will be appreciated that high-pressure fluid in the pumping chamber 110 is prevented from leaking from the fluid end 103 by the bore seal 121 described above.

Figure 9A:
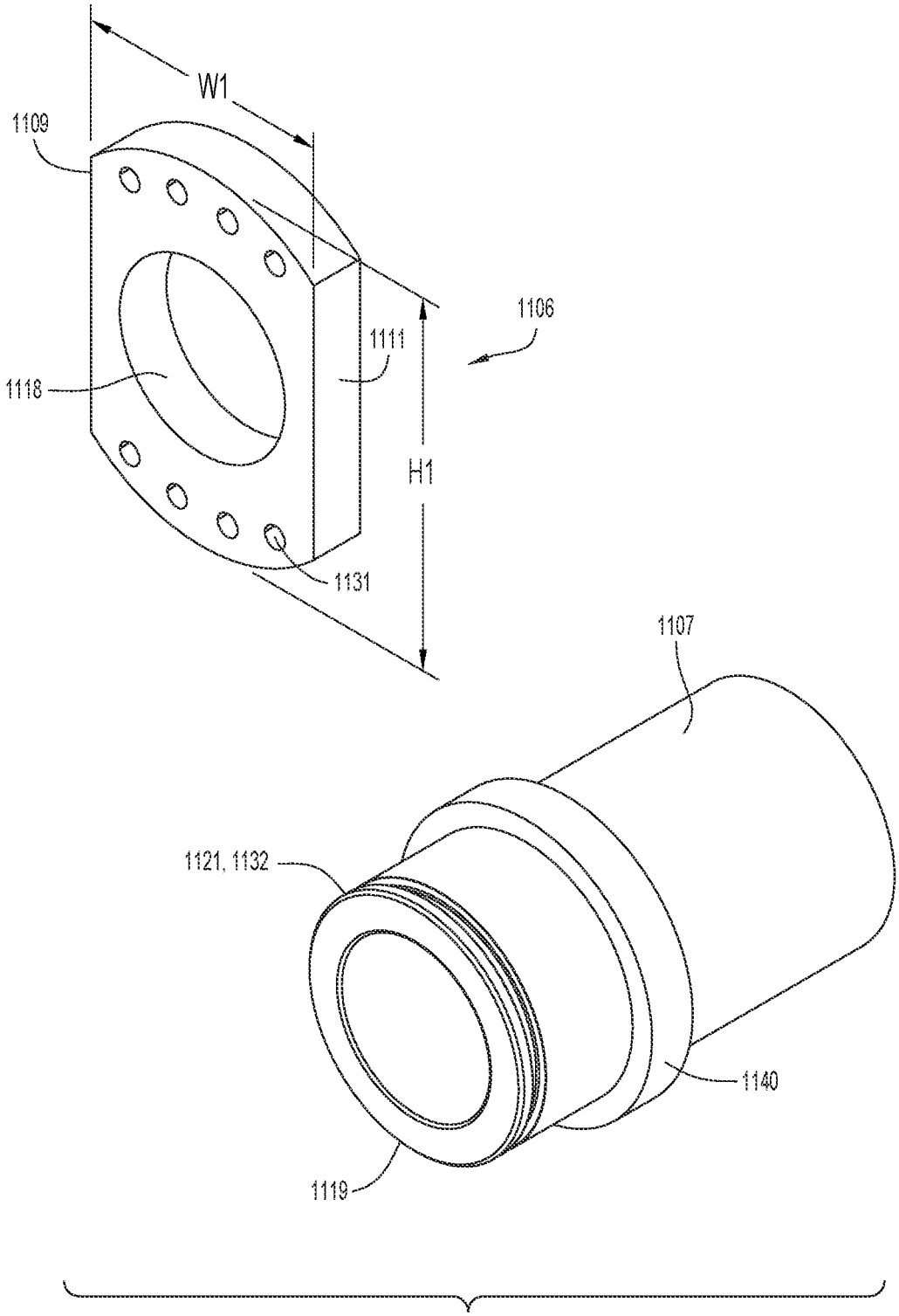
FIG. 9A is an exploded, perspective view of another example embodiment of a piston assembly liner formed in accordance with techniques of the present application.

FIG. 9A illustrates, in an exploded view, another example embodiment of a piston assembly 1106. In this embodiment, a flange 1109 is provided separately from the hollow cylindrical liner 1107. Generally, flange 1109 is similar to flange 109 and hollow cylindrical liner 1107 is similar to hollow cylindrical liner 107. Thus, for brevity, these parts are not described in great detail and any description of flange 109 or liner 107 should be understood to apply to the like parts of piston assembly 1106. Nevertheless, piston assembly 1106 is now briefly described to highlight differences.

First, as can be seen, flange 1109 is similar to flange 109 at least because it has a height H1 that may be greater than its width W1. The height H1 also varies around a circumference of the piston liner so that, for example, the flange 1109 may comprise a truncated disk with at least one flat edge 1111. These dimensions may allow multiple piston assemblies 1106 to be arranged side-by-side in the widthwise direction with little or no gap between the piston assemblies 1106, while at the same time providing sufficient room in the height direction for threaded fasteners to secure the flange 1109 to a fluid end casing (e.g., fluid end casing 108).

Additionally, flange 1109 may include a plurality of holes 1131 formed through the flange 1109 so that a plurality of threaded fasteners can extend through the plurality of holes 1131 to secure the piston assembly 1106 to a fluid end (e.g., fluid end 104). The plurality of holes 1131 may be formed concentric with, and equidistant from, a central longitudinal axis of a central opening 1118 formed in the flange 1109. The central opening 1118 may be sized and configured to engage the hollow cylindrical liner 1107, i.e., so that the flange 1109 can be removably installed around an outer circumference of the hollow cylindrical liner 1107. In other embodiments, flange 1109 may have any desirable shape, both exteriorly and interiorly (i.e., the central opening 1118) and/or may have any number and/or arrangement of holes 1131.

Second, and still referring to FIG. 9A, the hollow cylindrical liner 1107 may be substantially similar to liner 107. Thus, the hollow cylindrical liner 1107 may have an end part 1119 that can be inserted into a fluid end casing (e.g. fluid end casing 108) and a groove 1132 that supports a bore seal 1121, like end part 119, groove 132 and bore seal 121, respectively. However, in some embodiments, the hollow cylindrical liner 1107 may also have a lip 1140 that is configured to receive and support, at least longitudinally, the flange 1109. In the depicted embodiment, the lip 1140 is a continuous, annular protrusion with a rectangular cross-sectional shape. But, in other embodiments, the lip 1140 may have a different shape and/or configuration. For example, one or more portions of the lip 1140 can be tapered (e.g., to more securely engage the central opening 1118 of the flange 1109 and/or the lip 1140 may be discontinuous so that it only extends around one or more portions of liner 1107.

Regardless of how lip 1140 is constructed, the piston assembly 1106 may be assembled by sliding the flange 1109 over a distal end (i.e., an end opposite from end part 119) of the hollow cylindrical liner 1107 until the flange 1109 engages a downstream face of the lip 1140. Then, when the hollow cylindrical liner 1107 is installed on a fluid end casing, fasteners (e.g., fasteners 113) may be installed through holes 1131 and secured to the fluid end casing to sandwich the liner 107 between the flange 1109 and the fluid end casing. Additionally or alternatively, the flange 1109 may be secured to the hollow cylindrical liner 1107, e.g., via fasteners. Such an arrangement might allow the piston assembly 1106 to be assembled by sliding the flange 1109 over a distal end (i.e., an end opposite from end part 119) of the hollow cylindrical liner 1107 until the flange 1109 engages an upstream face of the lip 1140, if desired.

Figure 9B:
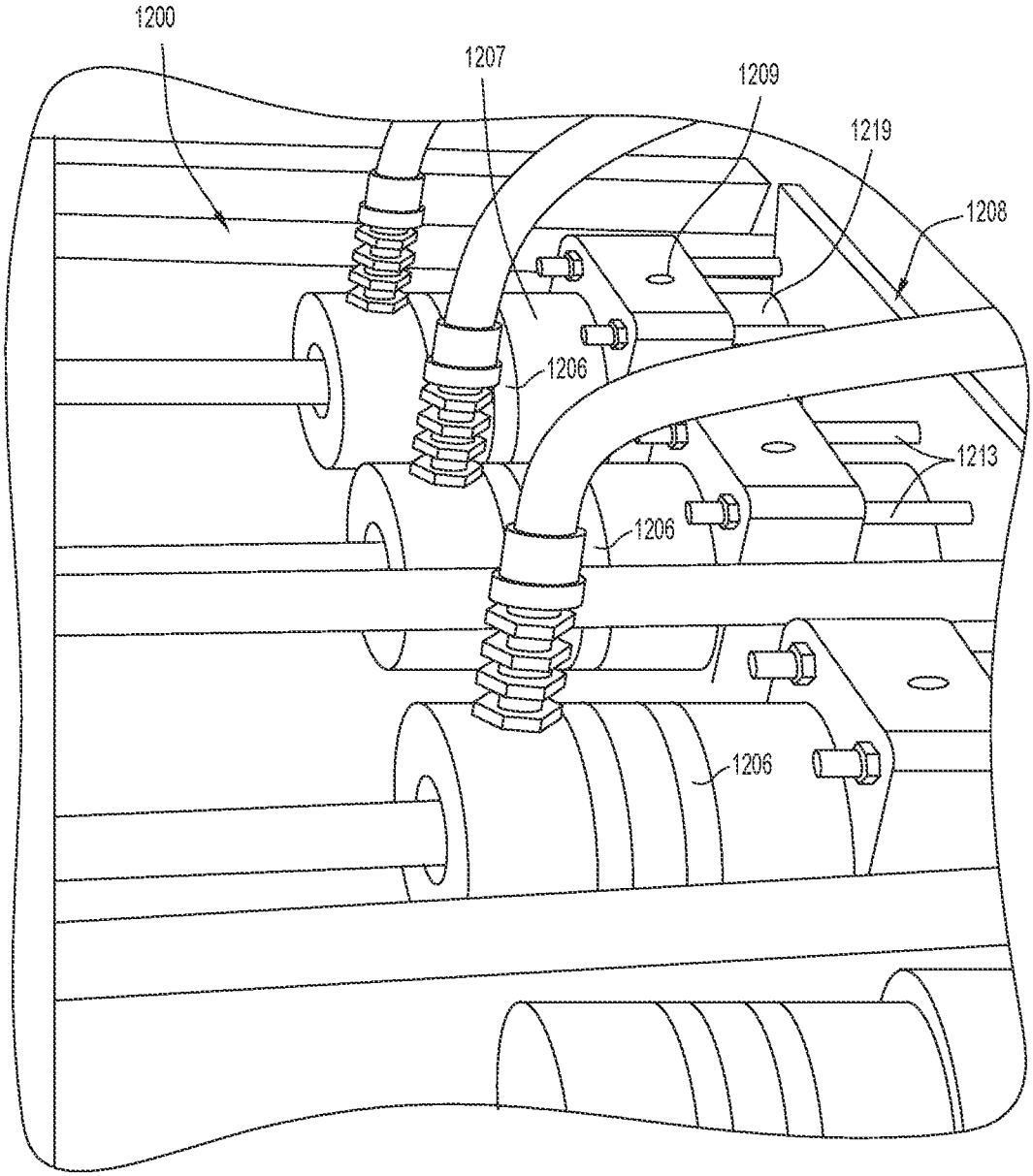
FIG. 9B is an a top perspective view of a portion of a reciprocating pump according including another embodiment of a piston assembly liner formed in accordance with techniques of the present application.

FIG. 9B illustrates a top perspective view of a portion of a reciprocating pump 1200 including yet another example embodiment of a piston assembly 1206 formed in accordance with the present application. In this embodiment, the pump 1200 includes a plurality of piston assemblies 1206 (three of which are pictured) and each piston assembly 1206 includes a flange 1209 and a hollow cylindrical liner 1207. Notably, the flange 1209 is substantially cuboidal and is spaced apart from a fluid end casing 1208, such that fasteners 1213 extending between the flange 1209 and fluid end casing 1208 traverse a gap. Additionally, piston assemblies 1206 are substantially spaced from each other and are each provided in their own frame sections (e.g., defined, at least in part, by stay rods extending beyond a power end and the fluid end casing 1208). However, aside from the positional and/or geometric differences, the hollow cylindrical liner 1207 is substantially similar to hollow cylindrical liner 107 (and liner 1107) and flange 1209 is substantially similar to flange 109 (and flange 1109), at least insofar as these like parts provide similar functionality. Thus, for brevity, these parts are not described in great detail and any description of flange 109 or liner 107 should be understood to apply to the like parts of piston assembly 1106.

Figure 10:
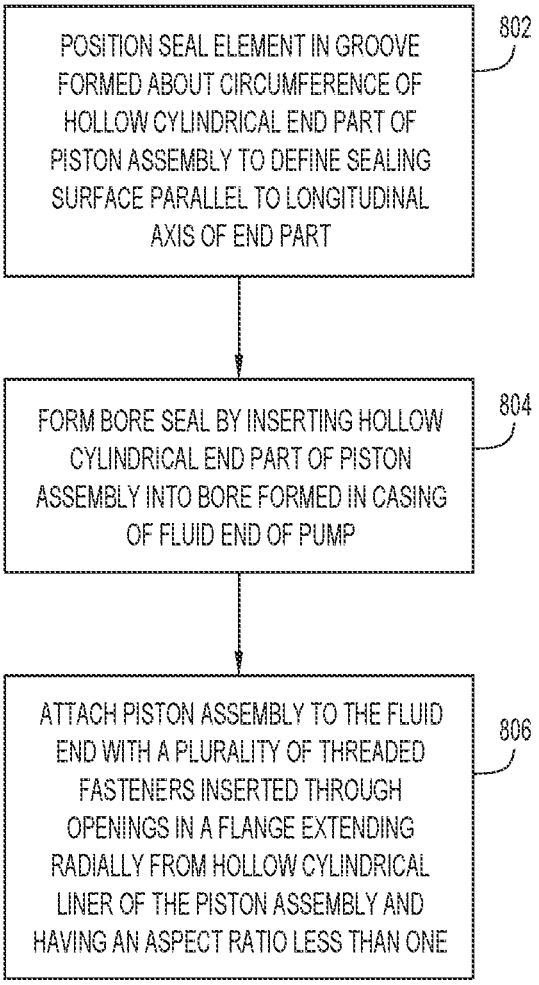
FIG. 10 is a flow chart illustrating a method of mounting a piston assembly on a fluid end of a reciprocating pump according to an example embodiment.

Referring now to FIG. 10, a flowchart 800 is shown illustrating a method of mounting a piston assembly on a fluid end of a high-pressure reciprocating pump as presented herein. Initially, at step 802, a ring-shaped seal element is positioned in a groove formed about the circumference of a hollow cylindrical end part of the piston assembly. For example, the ring-shaped seal element may be formed of an elastic material and sized such that it may be expanded from an original size to an expanded size to fit over the hollow cylindrical end part of the piston assembly, moved to the groove, and allowed to return to or at least towards its original size in the groove. Once the seal element is positioned in the groove, its height in a radial direction (relative to a longitudinal axis of the hollow cylindrical end part) may be such that it protrudes radially from the groove and defines a sealing surface parallel to the longitudinal axis of the hollow cylindrical end part of the piston assembly. In some embodiments, a pair of backup rings of somewhat shorter radial height may be positioned on opposite sides of the seal element in the groove to provide lateral support for the seal element.

At step 804, a bore seal is formed by inserting the hollow cylindrical end part of the piston assembly, with the seal element installed thereon, into a bore formed through a wall of a casing of the fluid end. In some embodiments, a radial gap between an outer circumference of the hollow cylindrical end part and an inner circumference of the bore is smaller than a radial height of the sealing element in an undeformed state such that, when the hollow cylindrical end part is inserted into the bore, the sealing element is compressed to form a seal between the two components.

At step 806, the piston assembly may be attached to the fluid end by inserting threaded fasteners through holes in a first flange extending radially outward from a hollow cylindrical liner of the piston assembly and threading the fasteners into threaded openings formed in the fluid end casing. In some embodiments, a width of the flange may be less than a height of the flange (i.e., the flange may have an aspect ratio less than one). In some embodiments, the width of the flange may be the same as a diameter of the hollow cylindrical liner, such that multiple piston assemblies may be arranged side-by-side in the width direction with their hollow cylindrical liners and flanges in close proximity to each other (e.g., abutting). In some embodiments, the flange may be configured as a truncated disk with at least one flat edge in the same plane as a flat surface on a side of the hollow cylindrical liner.

In some embodiments, the method may further comprise positioning a second piston assembly side-by-side with the first piston assembly in the width direction. In some embodiments, the first and second piston assemblies may each include a flange with at least one flat edge, and respective flat edges of the first and second piston assemblies may be positioned in close proximity to each other (e.g., to abut one another). In some embodiments, the method may further comprise positioning second and third piston assemblies on opposite sides of the first piston assembly in the width direction. In some embodiments, the first piston assembly includes a flange with two flat edges on opposite sides of the piston assembly, and the second and third piston assemblies each include a flange with at least one flat edge, and the method further comprises positioning the first piston assembly so that the two flat edges of its flange may be in relatively close proximity to respective flat ends of the second and third piston assemblies.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. For example, while the flange of the piston assembly is shown and described as a truncated disk with at least one flat edge, it will be appreciated that the flange may have other configurations, including without limitation a polygonal configuration (e.g., a rectangular, hexagonal, or octagonal configuration), or an elliptical configuration (with or without one or more flat edges) when viewed in plan. Also, while the pump is shown with three piston assemblies, it will be appreciated that the principles discussed herein may be applied to any reciprocating pump with two or more piston assemblies. Still further, while the piston assemblies are shown and described as being attached to the fluid end with eight fasteners, it will be appreciated that fewer or greater than eight fasteners may be used. Alternatively, the piston assemblies may be attached to the fluid end by clamping the flanges against the casing of the fluid end. Accordingly, it is appropriate that the appended claims be construed broadly and in a manner consistent with the scope of the disclosure. It is also to be understood that, unless otherwise stated, the sealing assembly described herein, or portions thereof may be fabricated from any materials commonly used for closure elements and/or seals.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

The invention claimed is:

1. A piston assembly for a reciprocating pump with a power end and a fluid end, the piston assembly comprising:

a hollow cylindrical liner with a longitudinal axis and an inner surface, the inner surface having a first inner diameter that remains constant along a length of the hollow cylindrical liner spanning the longitudinal axis so that the inner surface is configured to house and closely conform to a piston disposed within the hollow cylindrical liner, the piston including a piston seal configured to seal against the inner surface of the hollow cylindrical liner and the piston being configured to be coupled with the power end of the reciprocating pump;

a flange extending radially outward from a first end of the hollow cylindrical liner;

a hollow cylindrical end part extending in an axial direction from the flange and configured to be received in a bore formed in the fluid end of the reciprocating pump, the hollow cylindrical end part having a second inner diameter that is smaller than the first inner diameter and connected to the first inner diameter via an angled shoulder that delimits a top end of a stroke of the piston;

a groove formed about a circumference of an outer surface of the hollow cylindrical end part and positioned to face an inner side wall of the bore when the hollow cylindrical end part is inserted into the bore; and a seal element seated in the groove and protruding radially outward therefrom to form a seal between the hollow cylindrical end part and the inner side wall of the bore when the hollow cylindrical end part of the piston assembly is inserted into the bore.

2. The piston assembly of claim 1, wherein the flange is configured to abut the fluid end of the reciprocating pump.

3. The piston assembly of claim 1, wherein a width of the flange is less than a height of the flange.

4. The piston assembly of claim 3, wherein the hollow cylindrical liner includes a pair of flat surfaces formed on diametrically opposite sides of the hollow cylindrical liner, and wherein the width of the flange is the same as a distance between the pair of flat surfaces on the hollow cylindrical liner.

5. The piston assembly of claim 4, wherein the flange includes a pair of flat edges in same respective planes as the pair of flat surfaces on the hollow cylindrical liner.

6. The piston assembly of claim 5, wherein the pair of flat edges and the pair of flat surfaces are parallel to one another.

7. The piston assembly of claim 1, wherein an end face of the hollow cylindrical end part is configured to abut a shoulder defined by a counterbored portion of the bore in the fluid end.

8. The piston assembly of claim 1, wherein the seal element comprises a ring-shaped member made of a compressible material.

9. The piston assembly of claim 8, wherein the ring-shaped member has a round cross-section.

10. The piston assembly of claim 8, further comprising one or more backup rings disposed in the groove on one or more axial sides of the seal element.

11. The piston assembly of claim 1, wherein the flange is removably coupleable to the hollow cylindrical end part.

12. A reciprocating pump comprising:

a piston assembly extending from a first end to a second end, the piston assembly comprising:

a hollow cylindrical liner with a longitudinal axis and an inner surface, the inner surface having a first inner diameter that remains constant along a length of the hollow cylindrical liner spanning the longitudinal axis so that the inner surface is configured to house and closely conform to a piston disposed within the hollow cylindrical liner, the piston including a seal configured to seal against the inner surface of the hollow cylindrical liner;

a hollow cylindrical end part extending in an axial direction from the hollow cylindrical liner, the hollow cylindrical end part having a second inner diameter that is smaller than the first inner diameter and connected to the first inner diameter via an angled shoulder that delimits a top end of a stroke of the piston;

a groove formed about a circumference of an outer surface of the hollow cylindrical end part; and a seal element seated in the groove and protruding radially outward therefrom;

a power end configured to generate pumping power sufficient to drive the piston of the piston assembly in a reciprocating manner between the top end of the stroke and a bottom end of the stroke, the power end being coupled to the second end of the piston assembly; and a fluid end coupled with the first end of the piston assembly and comprising a casing with a pressure chamber, a fluid inlet opening, and a fluid outlet and a bore of circular cross-section formed therein, the bore being formed through a wall of the casing and being in fluid communication with the pressure chamber, wherein the hollow cylindrical end part of the piston assembly is inserted into the bore such that the groove is positioned to face an inner side wall of the bore and the seal element is disposed forms a seal between an outer circumference of the hollow cylindrical end part and the inner side wall of the bore.

13. The reciprocating pump of claim 12, wherein the piston assembly is one of a plurality of piston assemblies.

14. The reciprocating pump of claim 13, wherein the plurality of piston assemblies includes at least three piston assemblies, and one or more of the at least three piston assemblies comprises a flange including a truncated disk with two flat edges disposed between two other piston assemblies of the at least three piston assemblies.

15. A method of attaching a first piston assembly to a fluid end of a reciprocating pump, the method comprising:

positioning a seal element in a groove formed about a circumference of a hollow cylindrical end part of the first piston assembly, wherein the seal element protrudes radially outward from the groove, the hollow cylindrical end part extends in an axial direction from a flange disposed at a first end of a hollow cylindrical liner, wherein the hollow cylindrical liner has a longitudinal axis and an inner surface, the inner surface having a first inner diameter that remains constant along a length of the hollow cylindrical liner spanning the longitudinal axis so that the inner surface is configured to house and closely conform to a piston disposed within the hollow cylindrical liner along the inner surface, wherein the hollow cylindrical end part has a second inner diameter that is smaller than the first inner diameter and connected to the first inner diameter via an angled shoulder that delimits a top end of a stroke of the piston, and wherein the piston includes a seal configured to seal against the inner surface of the hollow cylindrical liner;

forming a bore seal by inserting the hollow cylindrical end part of the first piston assembly into a bore formed through a wall of a casing of the fluid end; and attaching the first piston assembly to the fluid end with a plurality of threaded fasteners extending through openings in the flange, which extends radially outward from the hollow cylindrical liner of the first piston assembly.

16. The method of claim 15, further comprising positioning a second piston assembly side-by-side with the first piston assembly in a width direction.

17. The method of claim 16, wherein the second piston assembly includes a second hollow cylindrical liner and a second flange extending radially outward from the second hollow cylindrical liner, and wherein a width of the second flange is less than a height of the second flange.

18. The method of claim 15, further comprising positioning second and third piston assemblies on opposite sides of the first piston assembly in a width direction.

* * * * *